United States Patent [19]

Schütz

[11] Patent Number: 4,483,298

[45] Date of Patent: Nov. 20, 1984

[54] VALVE

[75] Inventor: Rudolf Schütz, Ditzingen, Fed. Rep. of Germany

[73] Assignee: Robert Bosch GmbH, Stuttgart, Fed. Rep. of Germany

[21] Appl. No.: 592,738

[22] Filed: Mar. 23, 1984

Related U.S. Application Data

[63] Continuation of Ser. No. 200,649, Oct. 27, 1980, abandoned.

[30] Foreign Application Priority Data

Dec. 15, 1979 [DE] Fed. Rep. of Germany ..... 2950599

[51] Int. Cl.[3] ..... F02M 39/00

[52] U.S. Cl. ..... 123/452; 123/453; 251/321

[58] Field of Search ..... 123/452, 453, 454, 455; 251/321, 322, 323; 137/514.5, 543.23

[56] References Cited

U.S. PATENT DOCUMENTS

| | | | |
|---|---|---|---|
| 3,728,993 | 4/1973 | Eckert | 123/452 |
| 3,931,802 | 11/1976 | Eckert | 123/455 |
| 4,081,176 | 3/1978 | Johnson | 251/321 |
| 4,214,565 | 7/1980 | Knapp | 123/453 |
| 4,364,362 | 12/1982 | Wissmann et al. | 123/454 |

FOREIGN PATENT DOCUMENTS

| | | | |
|---|---|---|---|
| 2837692 | 7/1979 | Fed. Rep. of Germany | 123/454 |

*Primary Examiner*—Charles J. Myhre
*Assistant Examiner*—Carl Stuart Miller
*Attorney, Agent, or Firm*—Edwin E. Greigg

[57] ABSTRACT

A housed valve is proposed which serves in particular as a metering and distribution valve for a fuel injection system of a mixture-compressing internal combustion engine with externally supplied ignition. The valve includes a control slide with a control edge and at least two control slits. The control edge opens the control slits to a greater or lesser extent depending on the relative movement between the control slide and the control slits. A helical spring is supported on one control slide end, the end of the spring oriented toward the control slide being bent at an angle and arranged to protrude into an opening of the control slide end, while the other end of the spring is connected in a twist-free manner with the valve housing. As a result, there is a friction-free means of securing the control slide from twisting, so that deviations in the fluid quantities metered at the individual control slits can be equalized during the assembly of the valve by retroactive machining of the control edge in the various areas associated with the control slits.

3 Claims, 3 Drawing Figures

VALVE

This is a continuation of copending application Ser. No. 200,649 filed Oct. 27, 1980 now abandoned.

BACKGROUND OF THE INVENTION

The invention relates to a valve, in particular a metering and distribution valve for a fuel injection system, which includes a control slide provided with a control edge, and a valve housing provided with two control slits which are opened by the slide control edge to a greater or lesser extent upon a relative movement between the control slide and the control slits.

A valve is already known, in particular a distribution and metering valve in a fuel injection system for mixture-compressing internal combustion engines with externally supplied ignition, in which as a result of the differences in height of the control slits necessitated by manufacturing considerations the fuel quantities metered for the individual cylinders of the engine deviate from one another to an undesirably great degree, especially in the idling range, causing difficulties in setting the idling in the system. A retroactive machining of the control edge of the control slide in order to balance out the differences in height of the control slits is useful only if twisting of the control slide relative to the individual control slits is prevented. If the twisting of the control slide is prevented by means of a pin, which is connected to the control slide and can slide in a groove of the valve housing, then the result is an undesirable increase in the frictional force engaging the control slide.

OBJECT AND SUMMARY OF THE INVENTION

The valve according to the invention includes a helical spring which is supported at a first end of the control slide. The end of the spring orientated towards the control slide is bent at an angle and arranged to protrude into an appropriate embodied opening at the first end of the control slide, and the opposite end of this spring is connected with the valve housing in a twist-free manner.

The valve according to the invention has the advantage over the prior art that the control slide is secured against twisting without increasing friction, while assembly is simple and costs are low. In addition, the control slide is held in a predefined outset position by the helical spring whenever the valve is not functioning.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
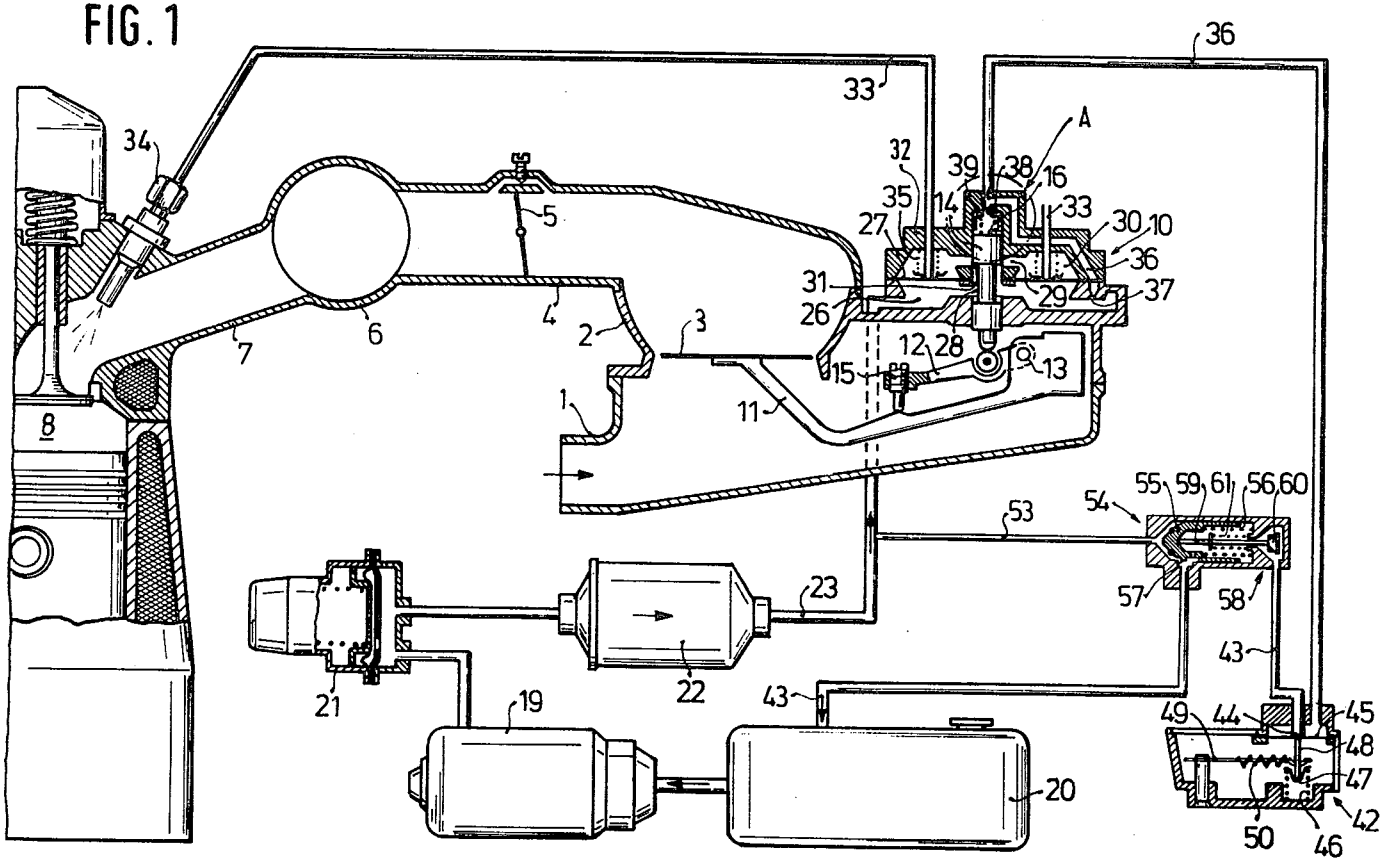
FIG. 1 shows a fuel injection system having a distribution and metering valve embodied in accordance with the invention.

In FIG. 1, a fuel injection system is shown which includes an intake manifold 1 having a conical section 2 which contains an air flow rate member 3, beyond which there is located an intake tube region 4 containing an arbitrarily settable throttle valve 5. Aspirated air flows through the intake tube in the direction of the arrow to a manifold 6, from which it is directed via individual intake tube regions 7 to one or more cylinders 8 of an internal combustion engine.

In the present case, the air flow rate member 3 is a baffle plate disposed transversely with respect to the direction of air flow and capable of displacement within the conical region 2 of the intake tube as an approximately linear function of the air flow rate through the tube. The air pressure between the air flow rate member 3 and the throttle valve 5 will be constant, provided that the restoring force acting on the air flow rate member 3 is constant and that the air pressure ahead of the member 3 is also constant. The air flow rate member 3 controls the opening of a metering and distribution valve assembly 10. The motion of the air flow rate member 3 is transmitted by an operating lever 11, which is pivoted on the same shaft as a correction lever 12 and which actuates the control slide 14, which is the movable member of the metering and distribution valve assembly 10. A mixture control screw 15 permits an adjustment of the desired fuel-air mixture. The end face 16 of the control slide 14 remote from the lever 11 experiences the pressure of a control fluid, which is exerted upon the air flow rate member 3 and acts as a return force in opposition to the force of the flowing air.

Fuel is supplied by an electric fuel pump 19, which aspirates fuel from a fuel tank 20 and delivers it through a storage container 21, a filter 22 and a fuel line 23 to the fuel metering and distribution assembly 10.

The fuel supply line 23 splits into several branches which lead to chambers 26 of the fuel valve assembly 10. One side of a diaphragm 27 in each chamber is affected by fuel pressure. The chambers 26 also communicate with an annular groove 28 of the control slide 14. Depending on the axial position of the control slide 14, the annular groove overlaps control slits 29 to varying degrees, permitting fuel to flow into chambers 30 which are divided from the chambers 26 by the diaphragm 27. From the chambers 30, fuel flows through the injection channels 33 to the individual injection valves 34, which are located in the vicinity of the engine cylinders 8 in the intake tube region 7. The diaphragm 27 is the movable valve member of a flat seat valve which is held open by a spring 35 whenever the fuel injection system is not operating. The diaphragm boxes, defined in each case by a chamber 26 and a chamber 30, insure that the pressure drop at the metering valve 28, 29, 31 is substantially constant, independently of the fuel quantity metered at the metering valve 28, 29, 31 and flowing to the injection valves 34. This insures that the metered-out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member 3. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 which is provided in the valve housing 32 and into which one end face 16 of the control slide 14 protrudes.

The control pressure line 36 contains a control pressure valve 42, which permits control fluid to return to the fuel tank 20 via a return line 43 without pressure. The control pressure valve 42 permits changing the pressure which produces the restoring force during the warm-up of the engine in accordance with time and temperature. The control pressure valve 42 is a flat-seat valve having a fixed control valve seat 44 and a diaphragm 45, which is urged in the closing direction by a spring 46. The spring 46 acts via a spring support 47 and a transmission pin 48 upon the diaphragm 45. When the engine temperature is below the normal operating temperature, a first bimetallic spring 49 acts in opposition to the force of the spring 46. The bimetallic spring 49 carries an electric heater 50, the operation of which after starting causes a diminution of the force of the bimetallic spring 49 on the spring 46, and by this means the control pressure in the control pressure line 36 increases.

Branching off from the fuel supply line 23 is a line 53, in which a pressure regulating valve 54 is disposed. By means of this pressure regulating valve 54, a constant fuel pressure is maintained upstream of the metering valve 28, 29, 31. The pressure regulating valve 54 shown by way of example in the drawing has a regulating piston 55, which can be displaced by the fuel pressure in the line 53 counter to the force of a regulating spring 56, so that fuel can flow out of the line 53 over a regulating edge 57 and back into the fuel container 20. A blocking valve 58 can be opened simultaneously by the regulating piston 55 as it opens, the blocking valve 58 being disposed directly downstream of the pressure control valve 42 in the return line 43. To this end, the regulating piston 55, as it opens and with the engine operating, engages an actuation pin 59, which displaces the movable valve member 60 in the opening direction counter to the force of a blocking spring 61. If the engine is turned off, then there is no further supply of fuel by the electric fuel pump 19, and the pressure regulating valve 54 closes. At the same time, the blocking spring 61 engaging the actuating pin 59 displaces the movable valve member 60 of the blocking valve 58 in the closing direction, so that the escape of fuel out of the control pressure line 36 via the pressure control valve 42 is precluded, and the fuel injection system remains filled with fuel, ready for a new start-up of the engine.

Figure 2:
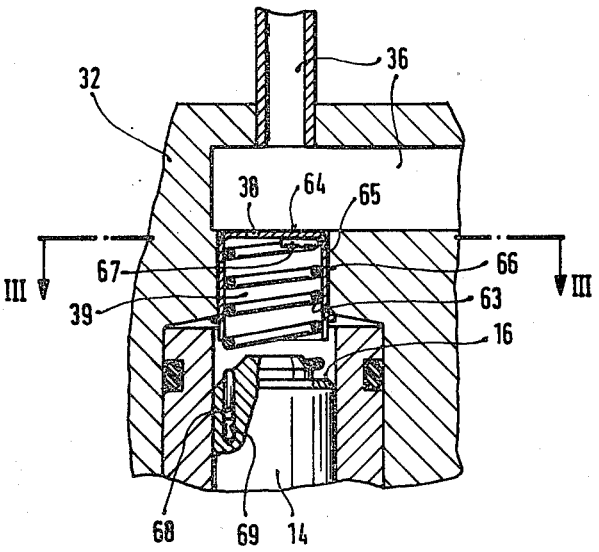
FIG. 2 is a detail A of the distribution and metering valve of FIG. 1, shown on a larger scale and with increased detail.
Figure 3:
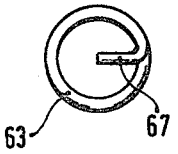
FIG. 3 is a section taken along the line III—III of FIG. 2.

The detail A, indicated in FIG. 1 with broken lines, is shown in FIG. 2 on a different scale and in more detail. A helical spring 63 is disposed in accordance with the invention in the pressure chamber 39, being supported at one end on the end face 16 of the control slide 14 and at the other end on the base 64 of a damping sheath 65 embodied in an inverted cuplike form. On its side remote from the end face 16 of the control slide 14, the base 64 defines the pressure chamber 39. The damping sheath 65 is inserted into an appropriate opening 66 of the valve housing 32 and secured against twisting. The damping throttle opening 38 is provided in the base 64 of the damping sheath 65. As shown in FIG. 3, the end 67 of the helical spring 63 oriented toward the base 64 of the damping sheath 65 is bent relative to the coiling of the spring. This spring end 67 is secured on the base 64, preferably by welding or soldering. The spring end 68 of the helical spring 63 oriented toward the control slide 14 is also bent at an angle from the spring coil, preferably in such a fashion that it extends parallel to the control slide axis and protrudes into an appropriately embodied opening 69 of the control slide 14 which is provided eccentric to and parallel with the control slide axis. The embodiment and disposition of the helical spring 63 in accordance with the invention thus prevents twisting on the part of the control slide 14. As a result, the fuel quantities metered at the individual control slits 29 can be measured and compared at a predetermined control position of the control slide 14, and if there are any deviations then the control edge 31 can be retroactively machined in the region of the pertinent control slits 29 until such time as identical metered fuel quantities result at the individual control slits.

The helical spring 63 is preferably embodied as yielding (that is, not stiff), having a flat spring characteristic, and its spring force exerted on the control slide 14 is very small in comparison with the force exerted on the control slide 14 by the pressure in the pressure chamber 39. When the engine is not operating, and the pressure in the lines and the units of the fuel injection system may have fallen to a pressure which is less than that of the atmosphere by an amount represented by the geodetic pressure difference between the fuel container 20 and the pressure chamber 39, then the spring force of the helical spring 63 is still sufficiently great to displace the control slide 14 into its outset position, in which position the control slits 29 are closed.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A metering and distribution valve for a fuel injection system comprising a valve housing, a control slide having a longitudinal axis and being axially movable along said axis in a bore in said housing, said control slide being provided with a control edge, at least two control slits communicating with said bore, said slits being opened to said bore by said control edge to a greater or lesser extent upon relative movement between said control edge and said control slits, and a helical spring disposed in a pressure chamber in said housing, said pressure chamber communicating via a damping throttle opening with a control pressure line that carries a pressurized fluid, said helical spring being supported at one end on an end of said control slide having an axially extending opening that is disposed eccentrically of said control slide longitudinal axis, said helical spring one end having a first bent portion extending axially into said control slide opening, said pressure chamber containing a perforated damping sheath which is secured against twisting in said housing, said damping sheath having one side exposed to said control pressure line and an opposite side disposed to said pressure chamber, said helical spring having at its other end a second bent portion, means securing said second bent portion in a twist-free manner to said damping sheath, said spring permitting axial movement of said control slide while constraining the latter against turning movement about its longitudinal axis.

2. A valve as defined in claim 1, in which said second bent portion of said helical spring is welded to said damping sheath.

3. A valve as defined in claim 1 in which said second bent portion of said helical spring is soldered to said damping sheath.

* * * * *